United States Patent [19]

Walden et al.

[11] Patent Number: 4,830,116

[45] Date of Patent: May 16, 1989

[54] FIRE EXTINGUISHING SYSTEM

[76] Inventors: James W. Walden, 1260 Pinnacle Cir., Pensacola, Fla. 32504; Jimmy E. Malone, 2899 Monica La., Pensacola, Fla. 32503

[21] Appl. No.: 69,835

[22] Filed: Jul. 6, 1987

[51] Int. Cl.[4] ..... A62C 35/00

[52] U.S. Cl. ..... 169/65; 169/17; 169/61

[58] Field of Search ..... 169/65, 61, 17

[56] References Cited

U.S. PATENT DOCUMENTS

| | | | |
|---|---|---|---|
| 2,509,497 | 5/1950 | Hesson | 169/61 |
| 3,653,443 | 4/1972 | Dockery | 169/65 |
| 3,865,192 | 2/1975 | Dunphy | 169/61 |
| 3,866,687 | 2/1975 | Banner | 169/65 |
| 3,993,138 | 11/1976 | Stevens et al. | 169/61 |
| 4,356,870 | 11/1982 | Gaylord et al. | 169/65 |
| 4,675,541 | 6/1987 | Peters et al. | 169/65 |

FOREIGN PATENT DOCUMENTS

| | | | |
|---|---|---|---|
| 3030142 | 2/1982 | Fed. Rep. of Germany | 169/61 |

*Primary Examiner*—Sherman D. Basinger
*Assistant Examiner*—Thomas J. Brahan
*Attorney, Agent, or Firm*—George A. Bode

[57] ABSTRACT

An automatic fire extinguishing system for ranges having top burners, including a hood, mountable over the range, tanks containing fire extinguishing fluids remotely located from the hood, solenoid operated valves connected in circuit with heat sensors and power lines to discharge fluid from the tanks when the heat sensors are operated. The range may have electric or gas burners. A solenoid operated switch or solenoid operated valve is connected in circuit with the heat sensors to open the power line to the electrical burners or to open the gas main to the gas burners when the heat sensors operate. An automatically operated exhaust fan and audible alarms are also provided. The system includes manually operable set and reset switch means.

9 Claims, 3 Drawing Sheets

* GAS RANGE USES SOLENOID VALVE

FIRE EXTINGUISHING SYSTEM

BACKGROUND OF THE INVENTION

1. Field of the Invention

The present invention relates to an automatically operated fire extinguishing system for either an electric o gas range and particularly concerns such a system associated with the hood over the range. More particularly, the system of the present invention extinguishes fire on the surface of the range and at the same time deactivates the electrical or gas source of energy to prevent the fire from re-starting.

2. General Background

Automatically operated fire extinguishing systems heretofore known for use in conjunction with ranges have generally been concerned with extinguishing a fire due to burning fat or grease in a cooking utensil. Such systems were solely concerned with extinguishing the fire and no provision was made for turning off the electric or gas burners of the range. Frequently the fire extinguishing system extinguished the lighted burners of a gas stove which only served to create a very hazardous condition by permitting fuel (gas) to flow freely from the burners into the atmosphere. When the system extinguished a fire over an electric range, the burners were left energized to reignite spilled grease and fat. No provision was made for automatically exhausting smoke and fumes generated during the fire and while it was being extinguished. Also, no provision was made for sounding an audible alarm. Inadequate provision was made for operating the entire system manually in lieu of or in addition to automatic operation. Further no provision was made to prevent a false engagement of the system. Even in some systems which automatically operated the fire extinguishing apparatus and deactivated the source of electricity or gas failed to provide a means to prevent a false activation of the system in the event of a momentary power outage.

Several attempts have been made in the prior art to develop a system for automatically extinguishing fires.

U.S. Pat. No. 3,463,233 issued to W. M. Haessler entitled "Method Of Extinguishing Deep Fat Fires" discloses, as best seen in its FIG. 1, a device providing a fire extinguishing system with mechanical means (35) for deactivating the range's power supply and, thereafter preventing its resumption upon actuation of the fire extinguisher. The shut-off switch is applicable to either gas or electric ranges.

U.S. Pat. No. 3,772,499 issued to D. E. Fritzsche entitled "Fryer Circuit For Use With A Hood Circuit Having Fire Protection Apparatus" discloses a device providing a fusible mechanical link (21) which at a predetermined temperature breaks and activates a switching means (20) that opens a circuit (11) thus deactivating the power source for the range and thereafter preventing its resumption and activates a fire extinguishing means.

U.S. Pat. No. 3,824,374 issued to E. J. Mayher entitled "Condition Responsive Disconnect Arrangement For Electrical Cooking Equipment" discloses a thermostat, safety circuit and contactor across an electrical power source (24) with the contactor (30) operating when energized to connect the heating the element (18) across the power source. The safety circuit includes a normally closed switch (38) actuated in response to a sensed abnormal condition to open the circuit thereby shutting off the power supply to the range and thereafter preventing its resumption and activating a source of carbon dioxide (44).

U.S. Pat. No. 3,653,443 issued to W. E. Dockery entitled "Fire Extinguishing System For Cook Stoves and Ranges" discloses means or shutting off a gas or electric range and thereafter preventing its resumption and activating a fire extinguishing system.

Other typical prior art patents include U.S. Pat. Nos. 3,283,827 issued to D. A. Diehl; 4,256,181 issued to C. C. Searcy; 4,524,835 issued to F. V. Mingrone; 4,356,870 issued to E. C. Gaylord; and, 4,066,064 issued to E. B. Vandas.

The present invention is directed to overcoming the above and other shortcomings, deficiencies, objects and disadvantages of prior systems employed for extinguishing fires on ranges and in hoods over the ranges.

According to the present invention, a removable and rechargeable fire extinguisher is installed remotely from an electric or gas range. Strategically located heat sensors on the hood of the range are connected in a circuit with means for breaking the circuit for the electrical lines energizing the burners of the electric range. Where a gas range is employed, the heat sensors are connected in circuit with a solenoid operated valve for turning off the gas supplied to the range. Also connected in circuit with the heat sensors are solenoid operated valves which turn on the fire extinguisher at pre-determined temperatures to discharge gaseous or liquid fire extinguishing agents around the hood and on the range. An exhaust fan may be provided in the system arranged to turn on automatically for exhausting fumes and smoke. Automatically operated audible alarms are also provided.

SUMMARY OF THE PRESENT INVENTION

A fire is detected by heat sensors mounted above an electric or gas range in the fan exhaust hood. The heat sensors are connected to electrical circuitry which includes a temperature comparator resistor. When the heat sensors detect fire the input resistance equals the pre-set resistance of a potentiometer and the output of the comparator drives a switch which energizes a first relay (by closing normally open (N/O) contacts) and turns on an audible alarm. At the time the first relay closes, another set of contacts for the same relay opens and that activates a first timer which after a delay of six (6) to twelve (12) seconds engages a second relay which in turn engages a third relay which performs the following switching. The third relay has a first set of normally open (N/O) contacts which close and engage a solenoid relief valve by switching a 120-Volt source to the relief valve which is located on a fire extinguishing canister. The canister's valve is opened and the released gas therefrom is communicated through spray nozzles located in the hood over the range. Then the third relay closes a set of normally open second contacts and activates the exhaust and deactivates the source of the electric or gas supply to the range. For gas ranges a third set of contacts on the third relay closes and engage a 120-Volt cut-off valve turning off the gas supply. For electric ranges the third set of contacts on the relay opens the voltage line to the range. In either case the final step the third relay performs is to activate the exhaust fan. The timer prevents false engagement as it must open for at least six (6) seconds for the unit to engage, thus preventing a momentary power outage from falsely activating the system.

It is, therefore, an object of the present invention to provide a fire extinguishing system for a range in which a fire extinguishing means is mounted in a hood over the range.

It is another object to provide a system with heat sensors connected in circuit with fire extinguishers to turn them on automatically, and further connected in circuit with solenoid operated switches or valves for turning off or opening the fuel line or electrical circuit energizing the burners of the range.

It is a further object of the present invention to provide a fire extinguishing system with means for automatically operating an exhaust fan in the event of fire to draw-off smoke after the fire is extinguished, and with means for operating an audible alarm annunciating the condition.

It is a further object of the present invention to provide two sources of fire extinguishing materials, halon and AFFF agent.

It is a further object of the present invention to provide a time delay means to prevent false engagement of the system caused by a momentary power outage.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
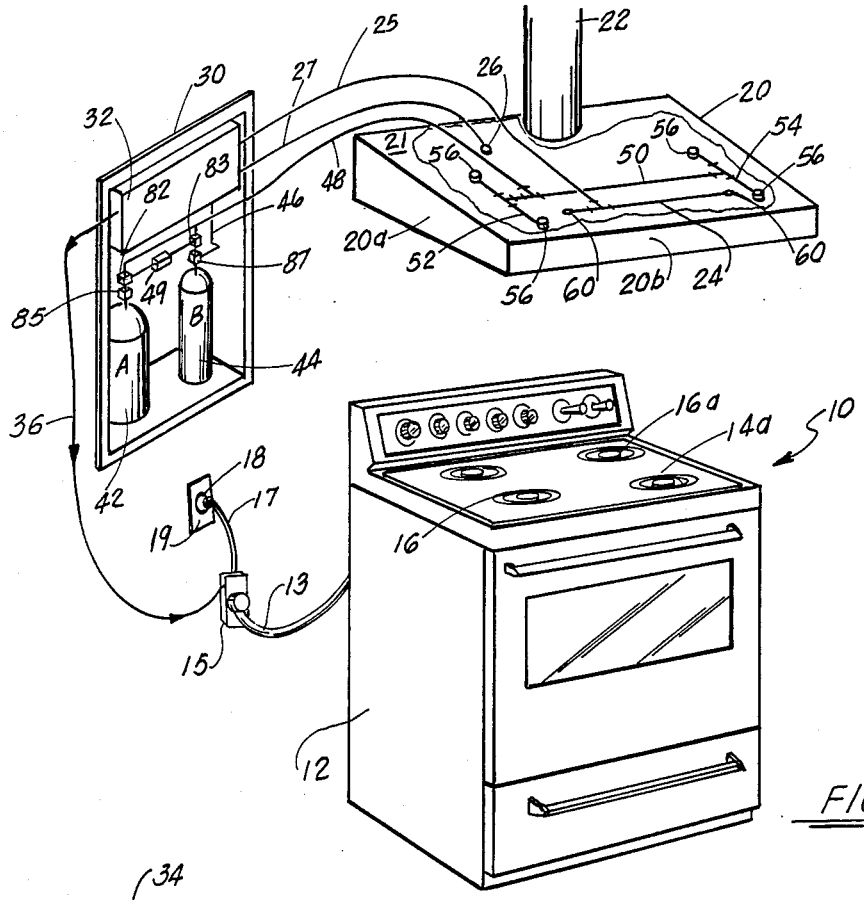
FIG. 1 is a perspective view of the preferred embodiment of the system of the present invention.
Figure 2:
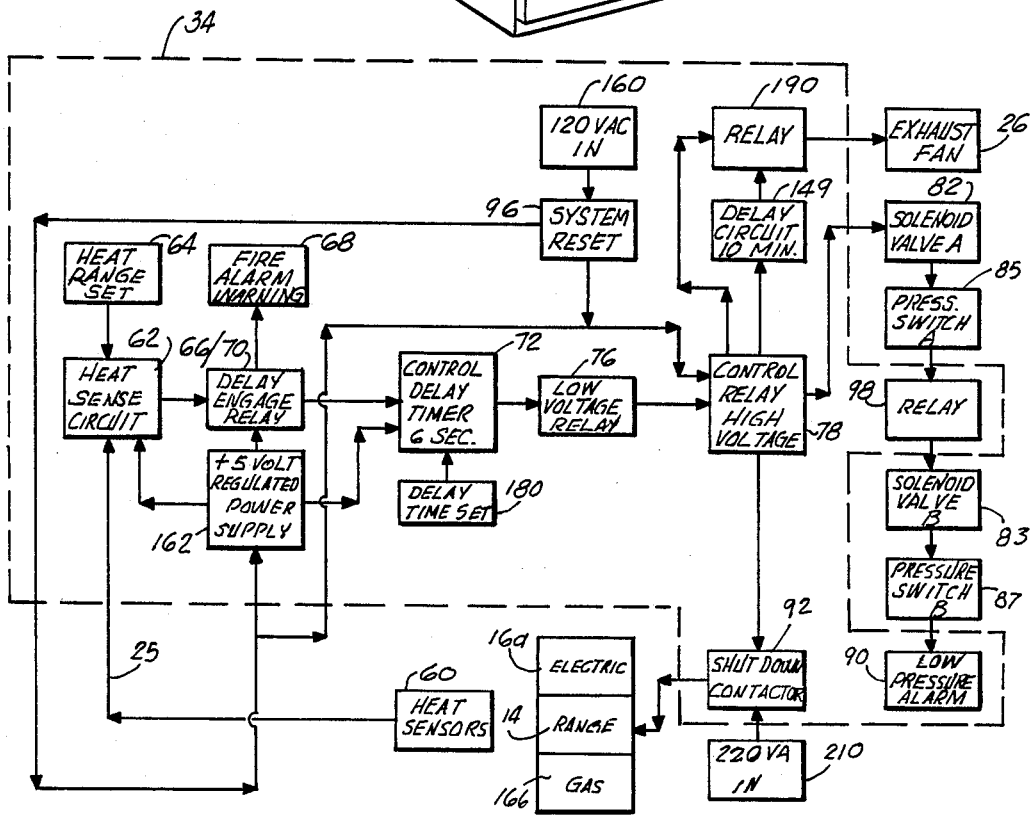
FIG. 2 is a schematic circuit illustration of the system of FIG. 1.
Figure 3:
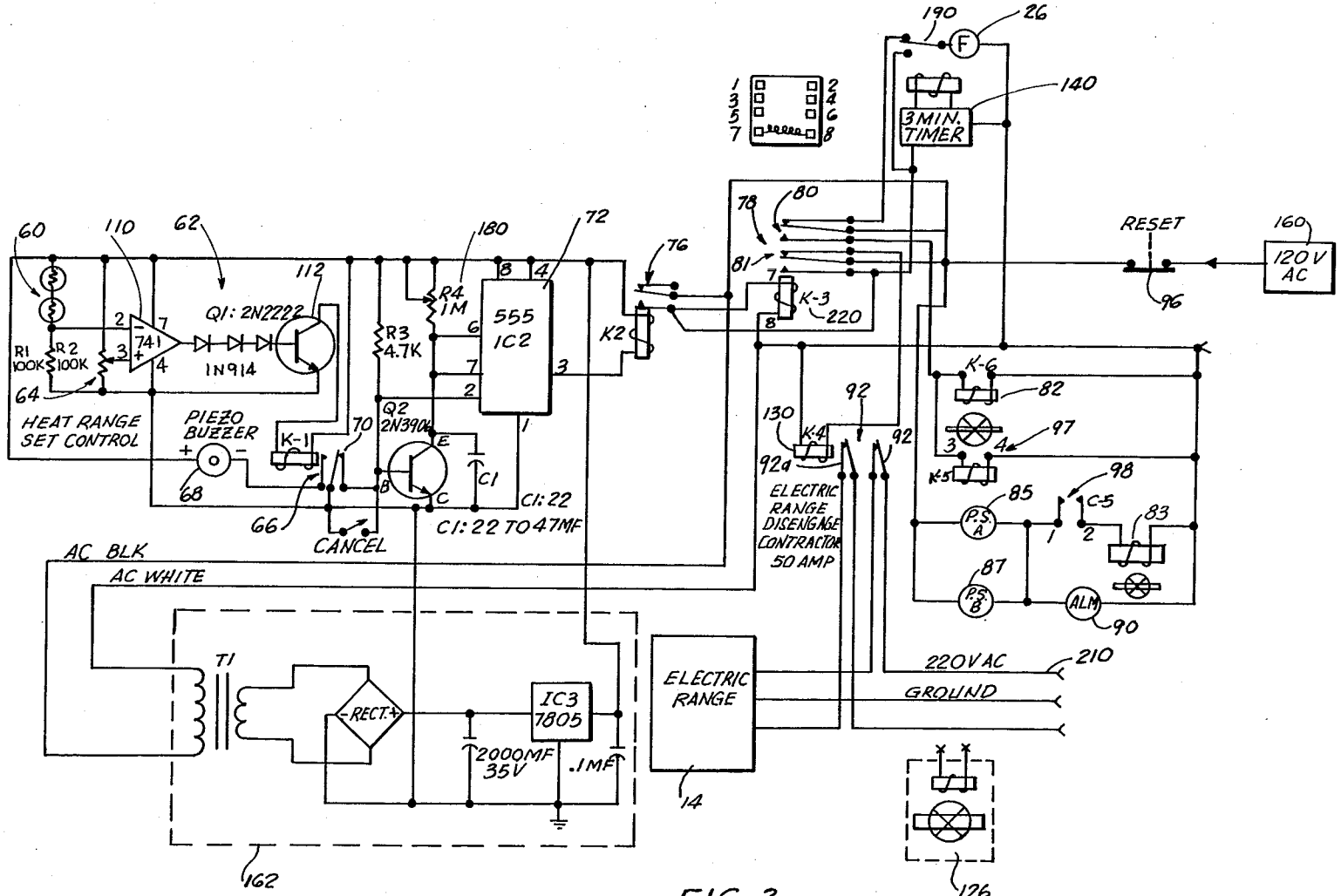
FIG. 3 is an electrical schematic of the control circuitry of the system of FIG. 1; and, FIG. 4 is a detailed schematic illustration of a portion of the control circuitry of FIG. 3.
Figure 4:
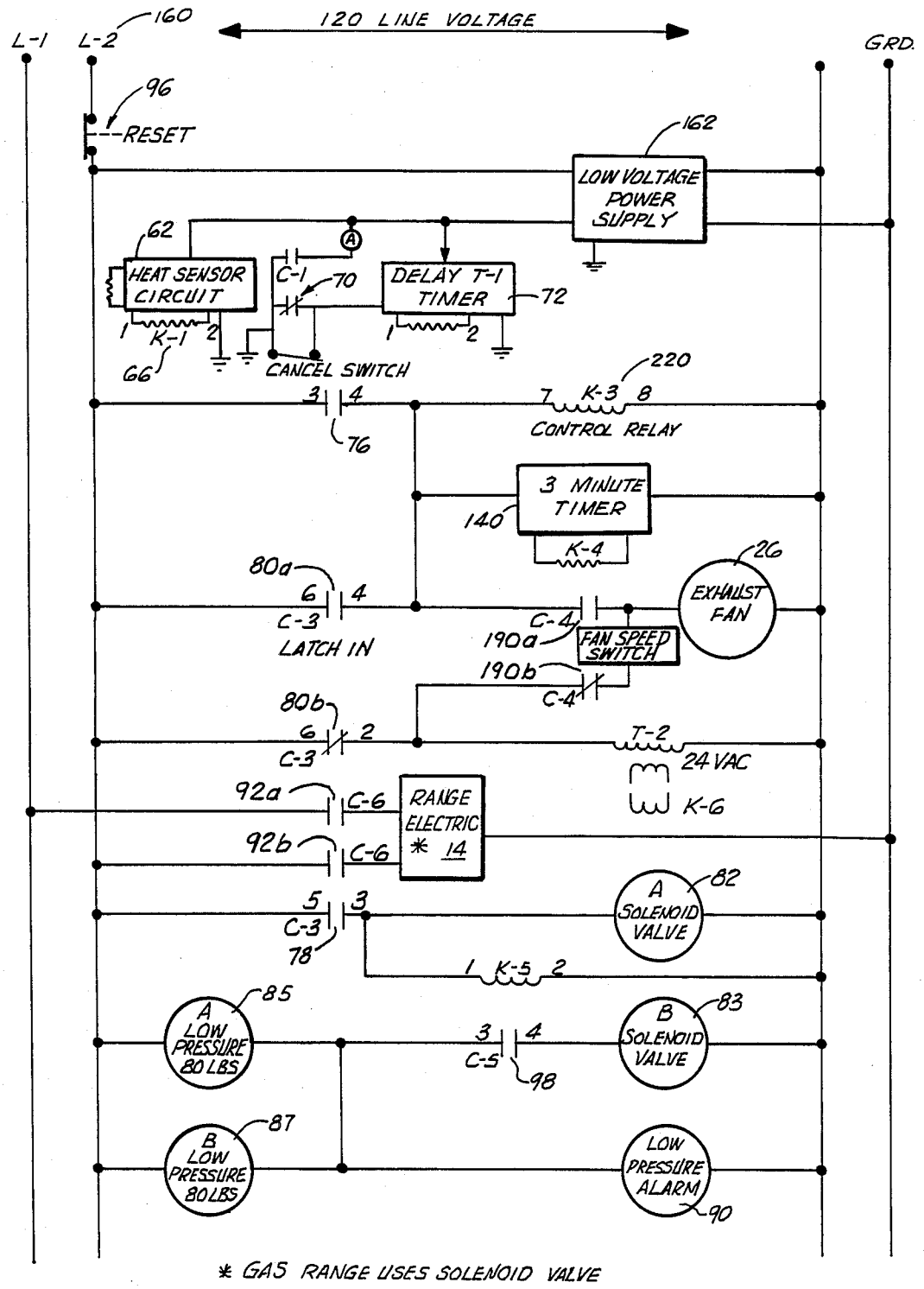

FIGS. 1–3 best illustrate the preferred embodiment of the system of the present invention, designated generally by the numeral 10, to extinguish fire on the surface of an electric or gas range and simultaneously deactivate the source of electrical or gas energy to keep the fire from re-starting.

As best seen in FIG. 1, conventional range 14 (either electric range 14*a* or gas range 14*b* having either electric source 16*a* or gas source 16*b* of heat respectively) mounted on stove 12 has positioned thereover hood 20 to exhaust heat and smoke through vent pipe 22. Hood 20 has a top 21 integral with four sides 20 *a–d* (although only two sides 20*a*, 20*b* are shown) and an open bottom. A fan, indicated at 26, provided in the underside of hood 20 aids in such exhausting. Also provided in the underside of hood 20 ar a plurality of thermistors or heat sensors 60 which are connected to a heat sensing circuit 62 by wiring 25. Heat sensing circuit 62 is a component of control circuit 34 which is provided in a control box 32 which in turn is mounted in cabinet 30 remotely located from range 14 and hood 20. Heat sensors 60 are connected to a source of power 18 by wiring 36, range contactor receptacle 15 (for connection to stove 12 via line 13) and wiring 17. As best seen in FIG. 1, the source of power 18 may be a conventional 110-Volt AC outlet mounted in wall plug 19.

Also provided in the underside of hood 20 are a plurality of spaced apart apertured spray nozzles 56 for discharging a fire extinguishing material over range 14 as will be described more fully hereinafter. Spray nozzles 56 are in fluid communication with tanks or canisters 42 (or "A") and 44 (or "B") for supply fire extinguishing material via line 48-50-52. Communication between nozzles 56 and canisters 42 and 44 is controlled by conventional 100-psi solenoid relief valves 82, 83 respectively. Solenoid relief valves 82, 83, normally closed (N/C) due to pressure switches 85, 87 respectively connected thereto, prevent communication between canisters 42, 44 and nozzles 56, and, therefore, discharge of the extinguishing material in canisters 42 and 44. A check valve 49 controls communication between canisters 42 and 44.

In operation and further describing control circuit 34 of the present invention 10, when a fire occurs on range 14, the flames are detected by thermistors or heat sensors 60 mounted above range 14 in fan exhaust hood 20. As best seen in FIG. 3, thermistors or heat sensors 60 are connected to a "741" operational amplifier comparator 110 in comparator circuit or heat sensing circuit 62. A temperature comparator resistance is set by potentiometer 64 and when the thermistors 60 detect the heat of the fire and the input resistance equals he set resistance, the output of the operational amplifier comparator circuit 62 drives a solid state switch 112 that engages relay 66 and turns on an audible alarm 68.

At the same time relay 66 closes, another set of contacts 70 of relay 66 open and that activates a "555" timer 72 pre-set (by potentiometer 180) for six (6) to twelve (12) seconds. At the end of the time delay, timer 72 through its output circuit develops a voltage that engages the next relay, relay 76. Relay 76 in turn engages a third relay, control relay 78, that will handle a heavier current to do the switching which occurs as follows. Control relay 78 has a first set of normally open (N/O) contacts 80 which close and engage 100-psi solenoid relief valve 82 by switching 120-Volts to relief valve 82 located on the fire extinguishing canister "A" or 42. The released gas is piped out via line 48 through four (4) fifteen (15°) degree angle spray nozzles 56 located over range 14 and mounted in the fan exhaust hood 20. Control relay 78 also has a second set of normally open (N/O) contacts 81 which close thus "latching in" relay 76. Control relay 78 is provided intermediate source of power 162 and solenoids 82, 83 in heat sensing circuit 62. Control relay 78 energizes solenoids 82, 83 and maintains said solenoids energized regardless of the temperatures sensed by heat sensors 60 after sensors 60 are first activated.

For gas a range 14*b*, normally open (N/O) control relay 78 controls relay 92 which has a set of contacts 92*a*, 92*b* which close and engage 120-Volt cutoff valve 126 (replacing electric range disengage contactor 130 in electric range 14*a*) thus turning off the gas supply. Loss of AC house power institutes a battery back up system (not shown).

For an electric range 14*a*, the third set of contacts 92 controlled by N/O relay 78 opens a source of voltage to relay 92 which opens the voltage line to electric range disengage contactor 130 thus disconnecting range 14*a* from it power source 210.

Control relay 78 also deactivates exhaust fan 26 in exhaust hood 20 for a predetermined time as controlled by timer 140.

Now Halon gas is released from canister "A" or 42 via line 48 to discharge at nozzles 56. Once the pressure in canister "A" or 42 drops below 25 p.s.i., pressure switch 85 for that canister closes contact 98 of relay 97 and gives an electrical path for solenoid relief valve 83 to be energized and activating low pressure alarm 90, and, the second canister "B" or 44 releases its "AFFF" agent. When the pressure in canister "B" or 44 drops below 25 psi second low pressure audible alarm 90 will again sound. Then the exhaust fan 26 switches on with the above-described time delay.

The purpose of timer 72 is to prevent a false engagement Timer 72 has to open for at least six (6) seconds for the units to engage. This prevents a momentary power outage from setting the unit off.

A reset means, switch 96, connected to 120-Volt source of power 160 allows entire system 10 to be reset.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An automatic fire extinguishing system for a range having top burners comprising:

(a) a hood mountable over said range, said hood having a closed top, vertical side walls and an open bottom;

(b) at least one tank containing fire extinguishing material disposed remotely from said hood and in fluid communication with spray means mounted in the open bottom of said hood;

(c) a solenoid operated valve on said tank for selectively releasing said fire extinguishing material when said solenoid is first energized;

(d) at least one heat sensing means activated at a pre-determined temperature and provided in said hood for sensing the temperature of a fire located between said range and said hood;

(e) a source of electric power;

(f) circuit means interconnecting said heat sensing means, said solenoid and said source of power for actuating said valve when said heat sensing means first activate upon the occurrence of a fire located between said range and said hood;

(g) first relay means provided in said circuit intermediate said source of power and said solenoid for energizing said solenoid and maintaining said solenoid energized regardless of the temperature sensed by said heat sensing means after said heat sensing means are once activated; and, (h) timer means in said circuit intermediate said heat sensing means and said first relay means for selectively delaying the energization of said solenoid.

2. The system of claim 1, wherein said spray means comprises an apertured pipe mounted inside said hood and connected to said tank via said valve for spraying said fire extinguishing material on said range and across said hood.

3. The system of claim 1, wherein said range includes electric burners, said system further comprising switch means connected in said circuit means for disconnecting said source of power supplied to said burners, and a second solenoid connected in said circuit and arranged to open said switch means when said first solenoid is energized by operation of said heat sensing means.

4. The system of claim 3, further comprising reset switch means connected in circuit with said first relay means for re-setting the same to deenergized condition and for deenergizing said solenoids to close said first switch means and to close said valve on said tank.

5. The system of claim 1, further comprising reset switch means connected in circuit with said first relay means for re-setting the same to deenergized condition and for deenergizing said solenoid.

6. The system of claim 5, further comprising a motor driven fan arranged to draw fumes and smoke from said hood; and, time delay relay means connected in circuit with said first relay means and said fan for operating said fan only after a pre-determined time has elapsed following the operation of said solenoid to discharge said fire extinguishing material from said tank.

7. The system of claim 6, further comprising an alarm connected in circuit with said first relay for actuation thereby when said first relay is energized.

8. The system of claim 1, wherein said range includes gas burners and a gas main connected to said burners, said system further comprising a second solenoid operated valve connected in said circuit and arranged to close said gas main when said first solenoid is energized by operation of said heat sensing means.

9. The system of claim 1, further comprising reset switch means connected in said circuit for deenergizing said solenoid after the same has become energized; and, manually operable set switch means connected in said circuit and arranged to energize said solenoid independently of the temperatures sensed by said heat sensing means.

* * * * *